US011672346B2

(12) United States Patent
Dempsey et al.

(10) Patent No.: US 11,672,346 B2
(45) Date of Patent: Jun. 13, 2023

(54) COLLAPSIBLE OUTDOOR SEATING WITH HINGE ASSEMBLIES

(71) Applicant: Two in Ten Holdings Inc., Toronto (CA)

(72) Inventors: Sean Dempsey, Toronto (CA); Heather Burns, Toronto (CA)

( * ) Notice: Subject to any disclaimer, the term of this patent is extended or adjusted under 35 U.S.C. 154(b) by 0 days.

(21) Appl. No.: 18/046,663

(22) Filed: Oct. 14, 2022

(65) Prior Publication Data

US 2023/0116794 A1 Apr. 13, 2023

(51) Int. Cl.

| | |
|---|---|
| ***A47C 7/40*** | (2006.01) |
| ***A47C 4/04*** | (2006.01) |
| ***A47C 7/66*** | (2006.01) |

(52) U.S. Cl.

CPC ..... *A47C 7/407* (2013.01); *A47C 4/04* (2013.01); *A47C 7/66* (2013.01)

(58) Field of Classification Search

None

See application file for complete search history.

(56) References Cited

U.S. PATENT DOCUMENTS

| | | | | | |
|---|---|---|---|---|---|
| 1,399,744 | A * | 12/1921 | Brophy | B60N 2/753 | 297/411.33 |
| 2,831,528 | A | 4/1958 | Charles | | |
| 3,309,134 | A * | 3/1967 | Roberts | A47C 4/52 | 190/8 |
| 5,069,503 | A * | 12/1991 | Martinez | A47C 1/146 | 297/378.12 |
| 5,449,220 | A * | 9/1995 | Taylor | A47C 1/029 | 297/445.1 |
| 5,779,112 | A * | 7/1998 | Krulik | A47C 4/52 | 224/655 |
| 5,957,349 | A * | 9/1999 | Krulik | A45F 3/04 | 224/655 |
| 6,371,581 | B1 * | 4/2002 | Ring | G07F 9/10 | 312/138.1 |
| 8,302,223 | B1 * | 11/2012 | Warner | A47C 7/425 | 5/656 |
| 9,307,840 | B2 | 4/2016 | Restrepo et al. | | |

(Continued)

FOREIGN PATENT DOCUMENTS

| | | | |
|---|---|---|---|
| CN | 203195134 U | * | 9/2013 |
| DE | 3011843 A1 | * | 10/1981 |

(Continued)

*Primary Examiner* — David E Allred

(74) *Attorney, Agent, or Firm* — Bhole IP Law; Anil Bhole; Marc Lampert

(57) ABSTRACT

There is provided an outdoor seat collapsible from an open position to a closed position. The seat including: a back rest that rotates until the back rest abuts a top of a seat rest to move to the closed position; a plurality of legs connected to the seat rest, the back rest, or both; and a front flap rotatably connected to the back rest or the seat rest, the front flap rotates to cover front facing portions of the back rest and the seat rest while in the closed position. Also provided is a hinge assembly, including an elongated hinge that defines a hole proximate to a first end and a slot proximate to a second end; the hole receives a first pin to permit rotation of a first portion, the slot receives a second pin to permit rotation and lateral movement of the hinge relative to a second portion.

10 Claims, 10 Drawing Sheets

(56) References Cited

U.S. PATENT DOCUMENTS

| | | | | |
|---|---|---|---|---|
| 9,635,945 | B2 | 5/2017 | Smithwick et al. | |
| 9,738,295 | B1 * | 8/2017 | Horowitz | B62B 1/20 |
| 10,874,222 | B2 | 12/2020 | Adams | |
| 10,881,211 | B1 * | 1/2021 | Al-Salloom | A47C 4/04 |
| 11,375,818 | B1 * | 7/2022 | Hu | A47C 7/0213 |
| 11,547,425 | B1 * | 1/2023 | Lebrija | A61B 17/1775 |
| 2017/0233044 | A1 * | 8/2017 | Davis | B63B 32/66 114/343 |
| 2018/0132618 | A1 * | 5/2018 | Klaseen | A47C 1/143 |
| 2019/0133336 | A1 | 5/2019 | Ennis | |
| 2019/0350372 | A1 | 11/2019 | Hirschhaut | |
| 2019/0374033 | A1 | 12/2019 | Grace | |
| 2020/0260876 | A1 * | 8/2020 | Shi | A47C 7/407 |
| 2020/0270051 | A1 * | 8/2020 | Greaves | B65D 81/368 |
| 2022/0183463 | A1 * | 6/2022 | Solomon | A47B 85/04 |

FOREIGN PATENT DOCUMENTS

| | | | | |
|---|---|---|---|---|
| DE | 202018105596 | U1 | * | 2/2020 |
| GB | 190614015 | A | * | 1/1907 |
| GB | 203056 | A | * | 9/1923 |
| KR | 20170132978 | A | * | 12/2017 |
| KR | 101817501 | B1 | * | 2/2018 |

* cited by examiner

COLLAPSIBLE OUTDOOR SEATING WITH HINGE ASSEMBLIES

TECHNICAL FIELD

The following relates generally to outdoor furniture, and more specifically, to collapsible outdoor seating with hinge assemblies.

BACKGROUND

Outdoor furniture has many benefits, as it presents the ability to add another room, such as on a deck, patio or lawn, to the outside of a house. However, obviously there are concerns with exposing this furniture to the weather and elements; especially where such furniture includes cushions. The furniture gets dirty and/or wet, which requires cleaning, drying, and/or maintenance prior to use. Some users will install covers over the furniture, but such covers are difficult and troublesome to install and remove for each use, as well as requiring storage of dirty and/or wet covers. Some users will remove cushions and put them in storage when not in use; however, such removal and retrieval of the cushions is exasperating for frequent use. To many users, this extra work presents a significant downside to use of the comfortable, cushioned outdoor furniture.

SUMMARY

In an aspect, there is provided an outdoor seat collapsible from an open position to a closed position, the seat comprising: a seat rest; a back rest rotatably connected to the seat rest, wherein to move to the closed position, the back rest rotates until the back rest abuts a top of the seat rest; a plurality of legs connected to the seat rest, the back rest, or both; and a first flap rotatably connected to the back rest or the seat rest, the first flap rotates to cover front facing portions or rear facing portions of the back rest and the seat rest while in the closed position.

In a particular case, the outdoor seat further comprising a second flap rotatably connected to the back rest or the seat rest, and wherein while in the closed position, the second flap rotates to cover rear facing portions of the back rest and the seat rest where the first flap covers front facing portions or the second flap rotates to cover front facing portions of the back rest and the seat rest where the first flap covers rear facing portions.

In another case of the outdoor seat, the back rest receives a back cushion therein and the seat rest receives a seat cushion therein, wherein the first flap or the second flap seals a rear facing exposure of the back cushion and the seat cushion while in the closed position, and wherein the first flap or the second flap seals a front facing exposure of the back cushion and the seat cushion while in the closed position.

In yet another case of the outdoor seat, the first flap is located behind the back rest and substantially parallel with a plane of the back rest while in the open position, the rotatable connection located between a top edge of the first flap and a top-rear edge of the back rest when viewed in the closed position.

In yet another case of the outdoor seat, the rotatable connection between the first flap and the back rest comprises a hinge assembly that rotates the first flap approximately 270 degrees.

In yet another case of the outdoor seat, the hinge assembly comprises an elongated hinge, a first pin connected to the first flap, and a second pin connected to the back rest, the hinge defining a hole proximate to a first end and a slot proximate to a second end, the hole receives the first pin to permit rotation of the first flap relative to the hinge, the slot receives the second pin to permit rotation and lateral movement of the hinge relative to the back rest.

In yet another case, the outdoor seat further comprising two or more of the hinge assemblies between the first flap and the back rest.

In yet another case of the outdoor seat, the hinge assembly further comprises a first magnet located on a side of the first flap that is proximate to the back rest in the open position, a second magnet located on a side of the first flap that is proximate to the back rest in the closed position, a third magnet located on the back rest and positioned to magnetically couple with the first magnet in the open position, and a fourth magnet located on the back rest and positioned to magnetically couple with the second magnet in the closed position.

In yet another case of the outdoor seat, at least one of the first magnet, the second magnet, the third magnet, and the fourth magnet are located in a ferromagnetic magnet cup.

In yet another case of the outdoor seat, at least one of the first magnet, the second magnet, the third magnet, and the fourth magnet comprise ferromagnetic material.

In yet another case, the outdoor seat further comprising arm rests rotatably connected to the legs, the arm rests rotate to abut the rear of the back rest while in the closed position.

In another aspect, there is provided a hinge assembly, comprising: an elongated hinge, the elongated hinge defining a hole proximate to a first end and a slot proximate to a second end; a first pin connected to a first portion of furniture to be rotated; and a second pin connected to a second portion of the furniture that is, at least temporarily, stationary relative to the portion to be rotated, the hole receives the first pin to permit rotation of the first portion relative to the hinge, and the slot receives the second pin to permit rotation and lateral movement of the hinge relative to the second portion.

In a particular case of the hinge assembly, the hinge assembly permits the first portion to rotate approximately 270 degrees.

In another case of the hinge assembly, the first portion comprises a flap.

In yet another case, the hinge assembly further comprises a first magnet located on a side of the first portion that is proximate to the second portion when in an unrotated position, a second magnet located on a side of the first portion that is proximate to the second portion when in a fully rotated position, a third magnet located on the second portion and positioned to magnetically couple with the first magnet when the first portion is in the unrotated position, and a fourth magnet located on the second portion and positioned to magnetically couple with the second magnet when the first portion is in the fully rotated position.

In yet another case of the hinge assembly, at least one of the first magnet, the second magnet, the third magnet, and the fourth magnet are located in a ferromagnetic magnet cup.

In yet another case of the hinge assembly, at least one of the first magnet, the second magnet, the third magnet, and the fourth magnet comprise ferromagnetic material.

These and other aspects are contemplated and described herein. It will be appreciated that the foregoing summary sets out representative aspects of the embodiments to assist skilled readers in understanding the following detailed description.

DESCRIPTION OF THE DRAWINGS

A greater understanding of the embodiments will be had with reference to the Figures, in which.

DETAILED DESCRIPTION

Figure 1:
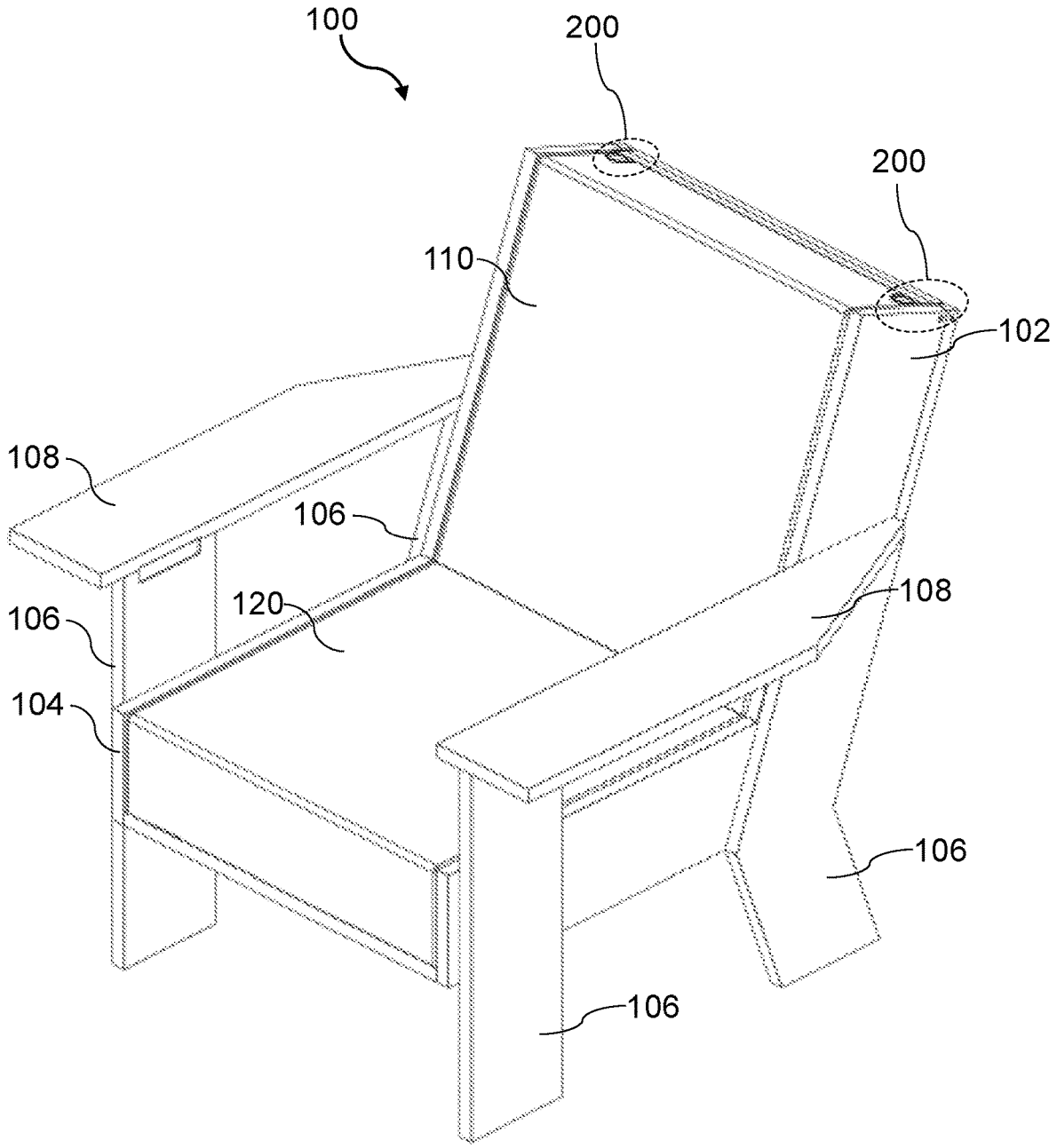
FIG. 1 is a dimetric view of a collapsible outdoor seat, in accordance with an embodiment, in an open position.

Embodiments will now be described with reference to the figures. For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practised without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

The following relates generally to outdoor furniture, and more specifically, to collapsible outdoor seating with hinge assemblies.

Figure 6:
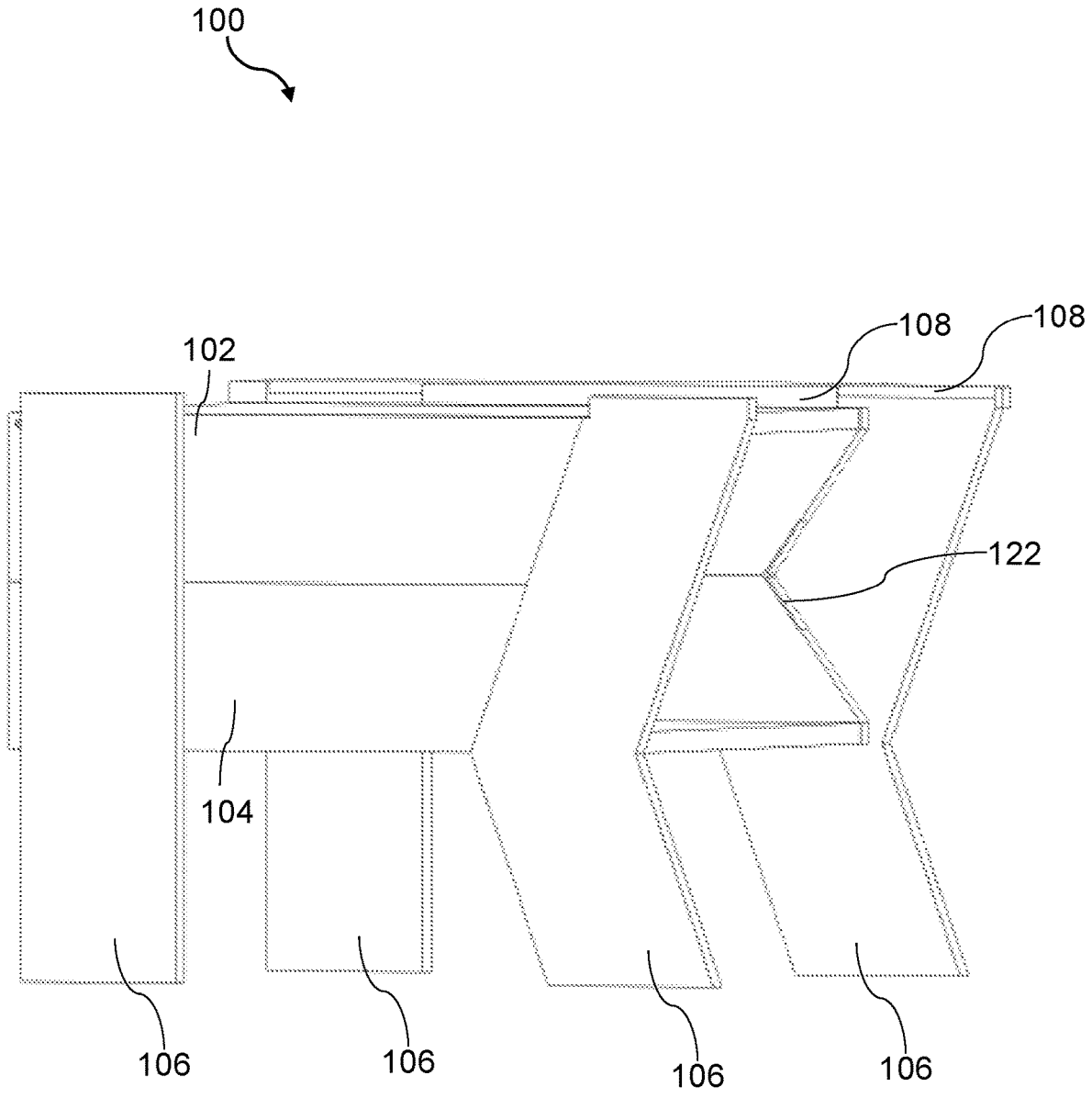
FIG. 6 is a dimetric rear view of the collapsible outdoor seat of FIG. 1 in the closed position.

FIG. 1 illustrates a dimetric view of a collapsible outdoor seat 100, in an open position, in accordance with an embodiment. In this configuration, the seat 100 is ready to be used by a user. The collapsible outdoor seat 100 incudes a back rest 102 connected to a seat rest 104 such that, as will be illustrated, the back rest 102 can rotate relative to the seat rest 104. The back rest 102 is connected to the seat rest 104 via a primary rotatable connection; such as a 110-degree hinge 122 (as illustrated in FIG. 6). The collapsible outdoor seat 100 further incudes legs 106 connected to at least the seat rest 104 and arm rests 108 located on, or to, the legs 106. In some cases, as will be illustrated, the arm rests 108 can rotate relative to the legs 106 via an armrest rotatable connection, such as using 180-degree hinges. In a closed position, having the arm rests 108 effectively face downwards, and in some cases abutting the rear side of the back rest 102, can prevent the arm rests from significantly accumulating water, dirt, dust, and debris.

In the embodiment of FIG. 1, the back rest 102 includes a back cushion 110 positioned therein and the seat rest 104 includes a seat cushion 120 positioned therein. As the cushions 110 and 120 are the major points of contact between a user and the seat 100, embodiments of the present disclosure advantageously protect the back cushion 110 and the seat cushion 120 from exposure to weather, water, dirt, and the elements. In further cases, the seat 100 could include other types of sitting/resting surfaces as part of the back rest 102 and/or the seat rest that are to be protected from weather and the elements.

Figure 2:
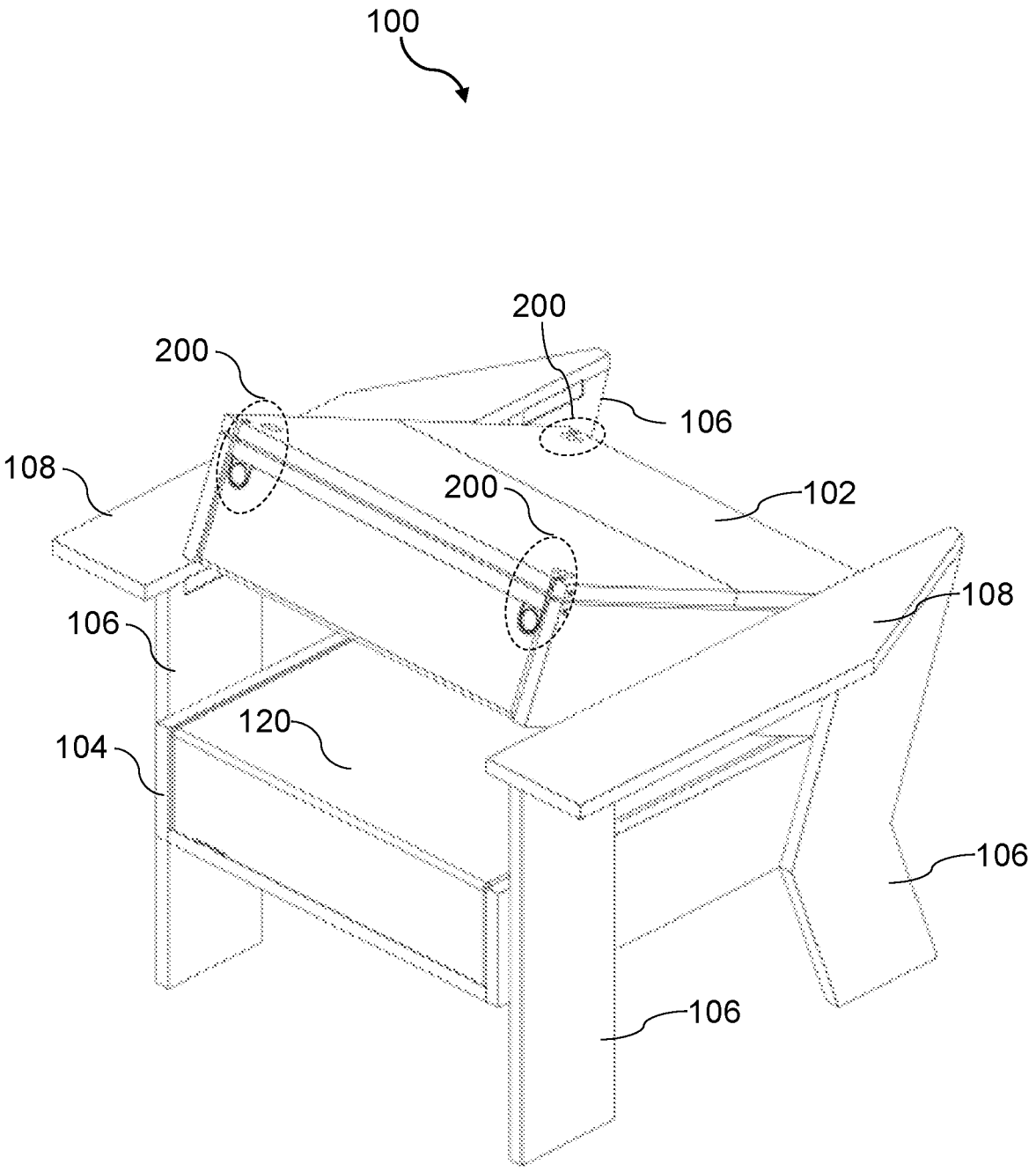
FIG. 2 is a dimetric view of the collapsible outdoor seat of FIG. 1 in transition to a closed position with a back rest partially folded down.

FIG. 2 illustrates a dimetric view of the collapsible outdoor seat 100 in an intermediate position between the open position and the closed position. As illustrated, the back rest 102 rotates with respect to the seat rest 104 as the seat 100 transitions from the open position to the closed position.

Figure 3:
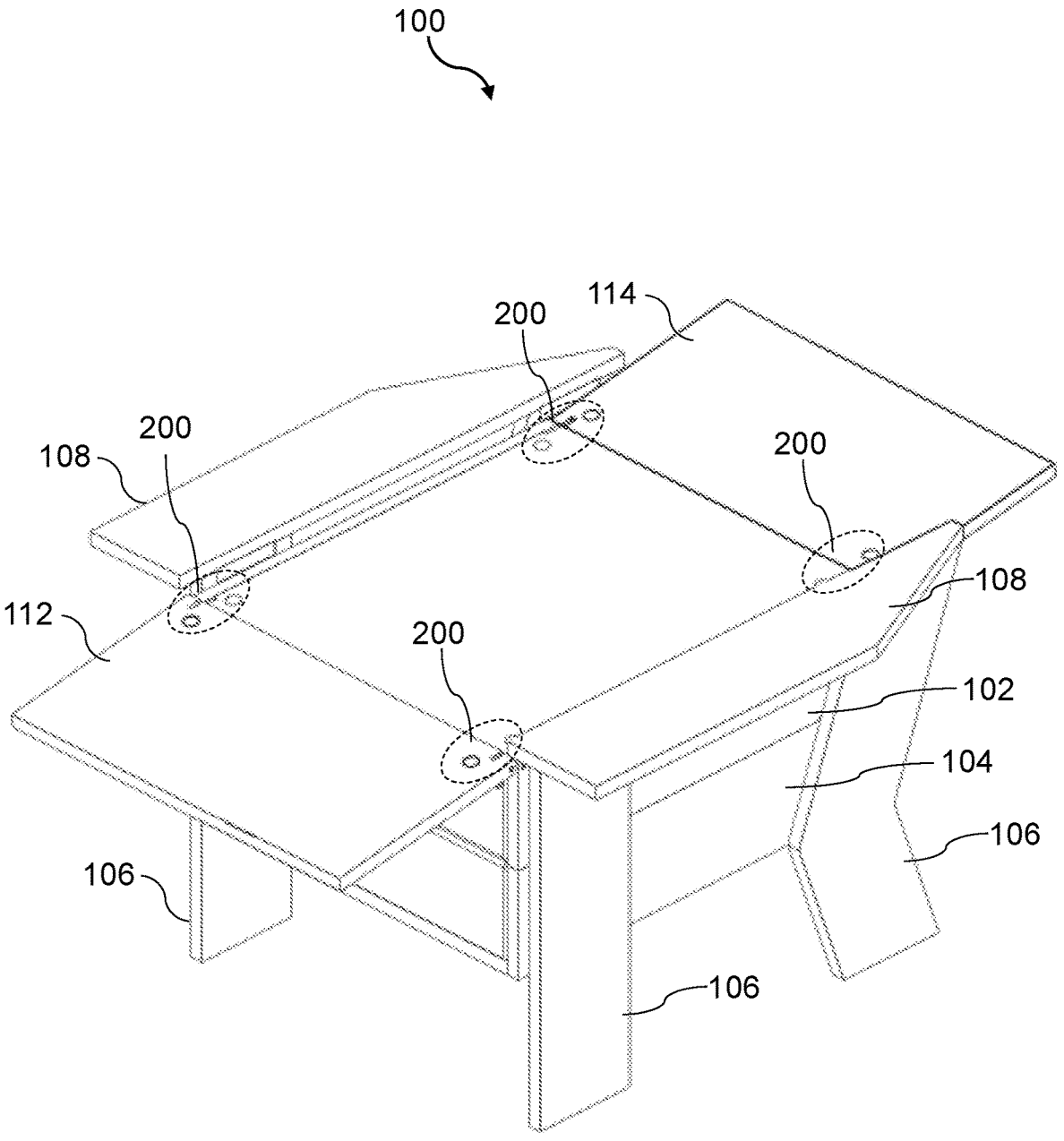
FIG. 3 is a dimetric view of the collapsible outdoor seat of FIG. 1 in transition to the closed position with the back rest fully folded down and with a front flap and a rear flap partially folded down.

FIG. 3 illustrates a dimetric view of the collapsible outdoor seat 100 in a further intermediate position between the open position and the closed position. In this position, the back rest 102 has completed its rotation such that the sides of the back rest 102 rest on the sides of the seat rest 104. In this way, the sides of the cushions 110 and 120 are protected from weather, dirt, and the elements because there is no significant gap between the sides of the back rest 102 and the sides of the seat rest 104.

As illustrated in FIG. 3, the seat 100 also includes a front flap 112 and a rear flap 114, which are stored behind the back rest 102 in the open position. The front flap 112 is connected to the top of the back rest 102 via a flap rotatable connection and the rear flap 114 is connected to the bottom of the back rest 102 also via a flap rotatable connection. In some cases, the flap rotatable connections can include a hinge assembly 200, as illustrated in FIGS. 7 to 12, at each corner. As the seat 100 transitions from the open position to the closed position, the front flap 112 is rotated relative to the top of the back rest 102 to fold down to cover the front exposed portions of the cushions 110 and 120; as illustrated in the closed position of FIG. 5. The rear flap 114 is also rotated relative to the bottom of the back rest 102 to fold down to cover the rear exposed portions of the cushions 110 and 120; as illustrated in the closed position of FIG. 5.

Figure 4:
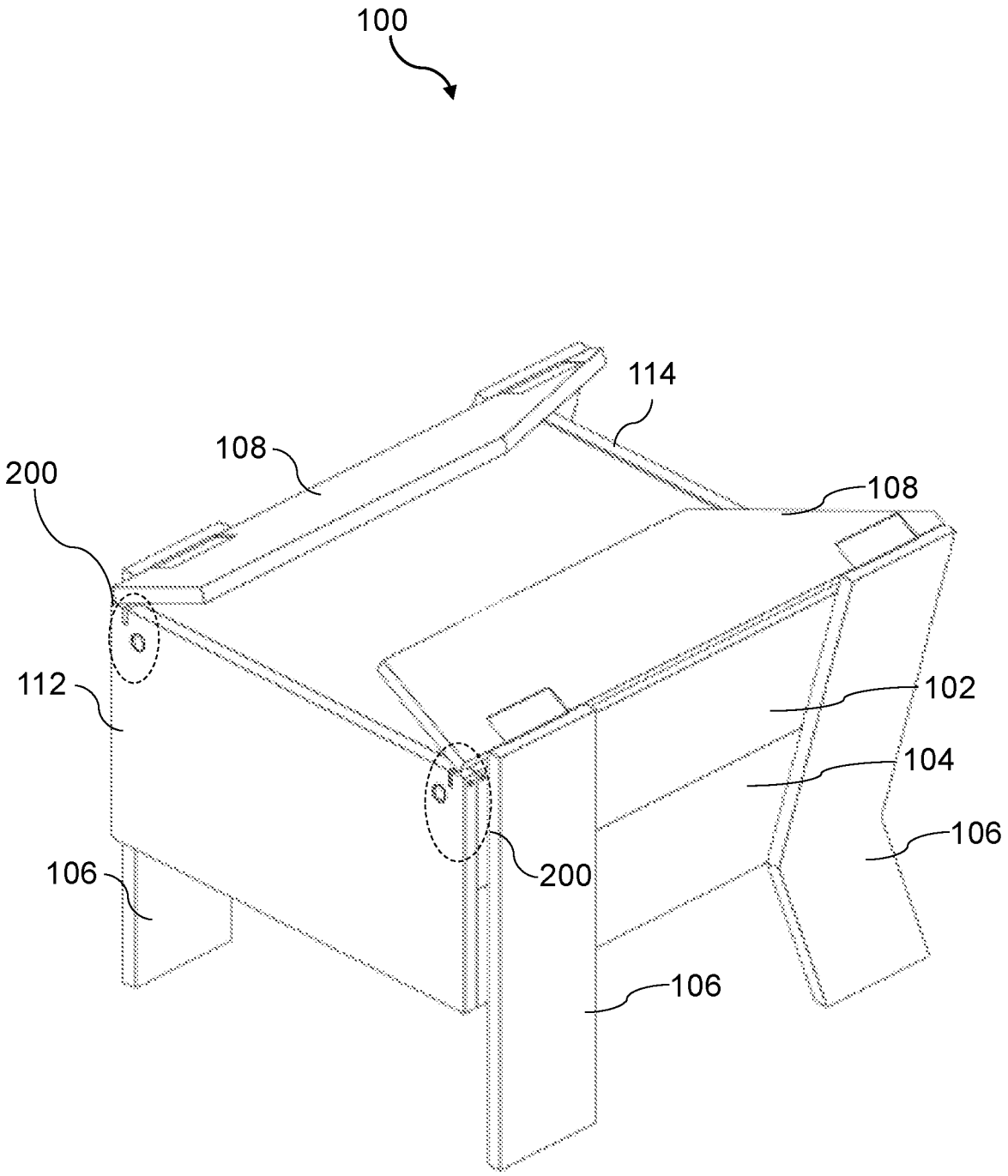
FIG. 4 is a dimetric view of the collapsible outdoor seat of FIG. 1 in transition to the closed position with arm rests partially folded down.

In some cases, as illustrated in the dimetric view of the seat 100 shown in FIG. 4, the arm rests 108 can rotate relative to the legs 106 and fold over top of the back rest 102, such that the closed position is more compact. However, in other cases, the arm rests 108 can be fixed to, or part of, the legs and/or the seat rest 104 and/or the back rest 102.

Figure 5:
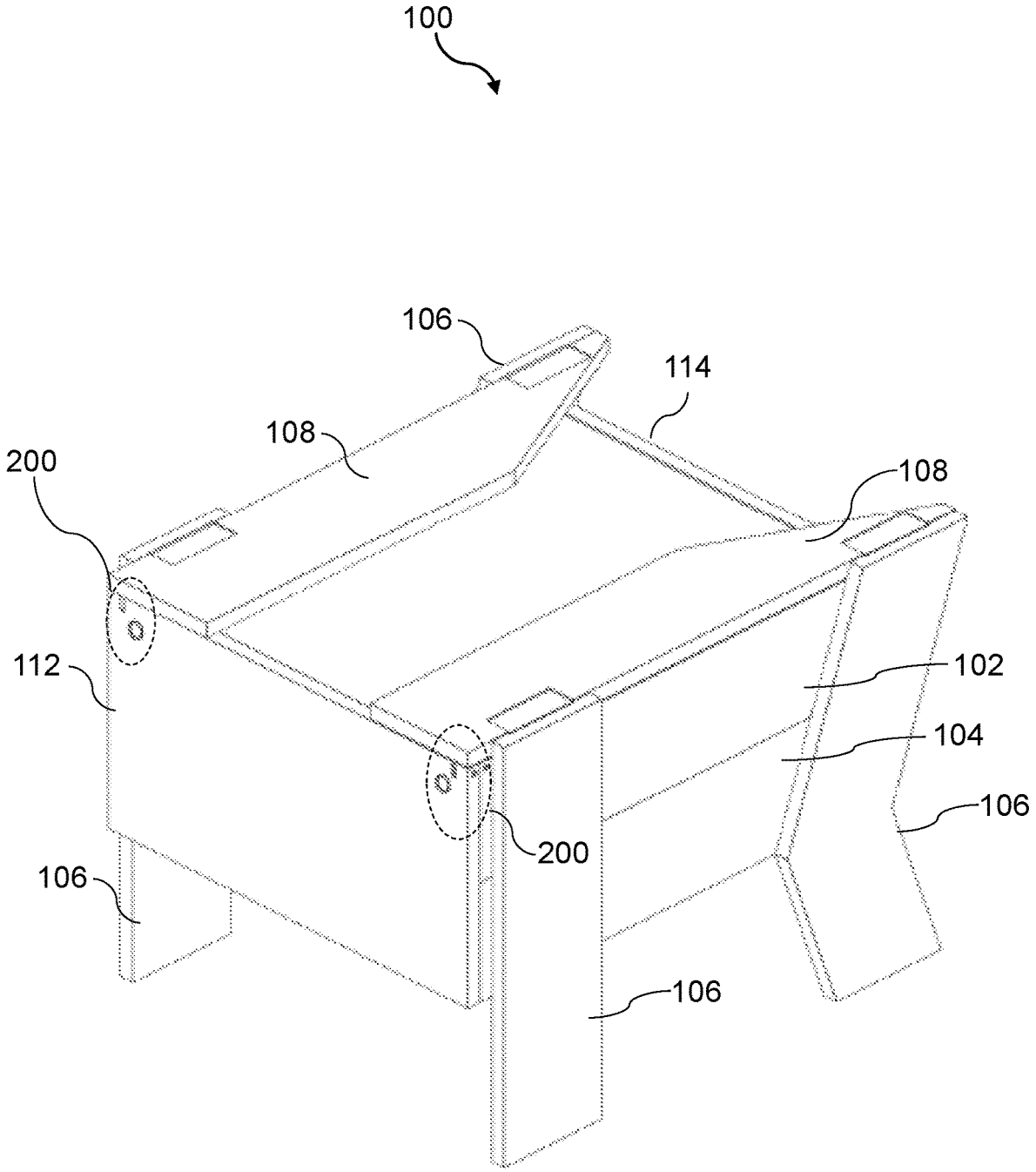
FIG. 5 is a dimetric view of the collapsible outdoor seat of FIG. 1 in the closed position.

FIG. 5 illustrates a dimetric view of the collapsible outdoor seat 100 in the closed position.

Advantageously, transitioning from the open position to the sealed closed position, the seat 100 incorporates all of the same elements and does not require installing a further unincorporated element; such as installing a cover, or removing the cushions. Additionally, the seat 100 includes many benefits for shipping in that, the seat 100 can ship in the closed position and require no further assembly when arriving at the destination.

Figure 7:
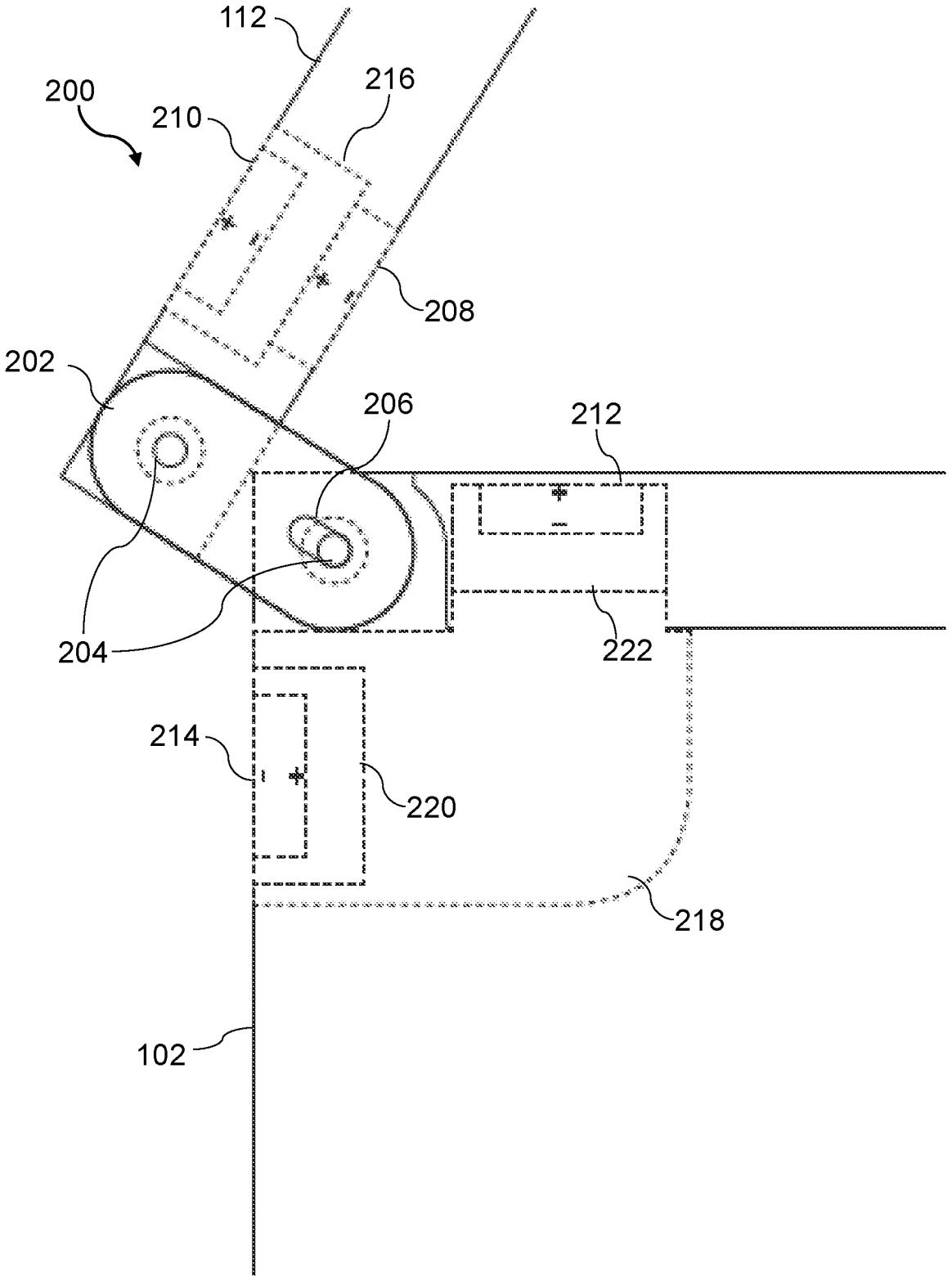
FIG. 7 is a side elevation view of a hinge assembly, in accordance with an embodiment, and in this example located between a front flap and a back rest of the collapsible outdoor seat of FIG. 1.

FIG. 7 illustrates a side elevation view of the hinge assembly 200. This illustrated example shows one of the hinge assemblies 200 between the front flap 112 and the back rest 102. It is understood that the same hinge assembly 200, as illustrated in FIGS. 7 to 12 and as described below, can be likewise used between the rear flap 114 and the back rest 102.

The hinge assembly 200 includes an elongated hinge 202 that is held in place to the front flap 112 and the back rest 102, respectively, by pins 204; allowing the front flap 112 to rotate relative to the hinge 202 and the hinge 202 to rotate relative to the back rest 102. On the side proximate the back rest 102, the hinge 202 defines a slot 206 for receiving the pin 204. The slotted hinge 202 design advantageously allows the front flap 112 to permit lateral movement (i.e., pull away) from the back rest 102 such that it can rotate a full 270-degrees without the corner of the front flap 112 getting impeded by the corner of the back rest 102. Assembly of the hinge assembly 200 can include having the pins 204 pushed inwards from the outside edge, through the hinge 202, continuing on through to the back rest 102 or the front flap 112. The pins 204 can be held in place by, for example, friction, threading, or adhesives.

The hinge assembly 200 can also include a number of magnets (e.g., neodymium (rare earth) magnets) for holding the front flap 112 in place in both the open position and the closed position. As part of the hinge assembly 200, the front flap 112 includes a first magnet 208 and a second magnet 210 located on opposing sides of the front flap 112. Also as part of the hinge assembly 200, the back rest 102 includes a third magnet 212 and a fourth magnet 214 located on a rear side and a top side, respectively, of the back rest 102.

In the open position, the front flap 112 is held abutting the rear of the back rest 102 by virtue of having the first magnet 208 magnetically coupled to the third magnet 212. In the closed position, the front flap 112 is held abutting the top of the back rest 102, and the front of the seat rest 102, by virtue of having the second magnet 210 magnetically coupled to the fourth magnet 214.

In the embodiment of FIG. 7, the second magnet 210 is located in a first ferromagnetic magnet cup 216, which magnifies the effect of the second magnet 210 by approximately four times. The magnet cup 216 also acts as a ferromagnetic backing plate for the first magnet 208, which magnifies the effect of the magnet by approximately two times. In further cases, the first magnet 208 can also be located in a further ferromagnetic cup (not shown). A second ferromagnetic cup 220 can be used to hold the fourth magnet 214 to amplify its effects, as above. A third ferromagnetic cup 222 can also be used to hold the third magnet 212 to amplify its effects, as above. The ferromagnetic cups can be used to magnify the effect of the magnets by eliminating air gaps and approximately bring both poles of the magnet to grip on the same surface.

Additionally, a plug 218 can be used to hold the second magnet cup 220 and the third magnet cup 222, and hold itself in position in a hole drilled into the back rest 102. The plug 218 can be made of any suitable material, such as plastic or metal. The plug 218 can be used to hold magnet 214 in the correct place to receive magnet 210. The plug 218 can also be used for fastening magnet cups 220 and 222 to it; thereby holding magnets 212 and 214 in a correct position. The plug 218 can also be used for pushing and holding magnet 212 close to the top surface to receive attraction from magnet 208. The hole drilled in the back rest 102 to receive the magnet cup 222 also receives the plug to ensure that it is in the right place. Adhesive can be added to this hole to secure the plug. Because of its complexity, as discussed it can be manufactured and assembled as a single part (x 4 per chair) and the manufacturer then just needs to drill holes in the material.

Figure 8:
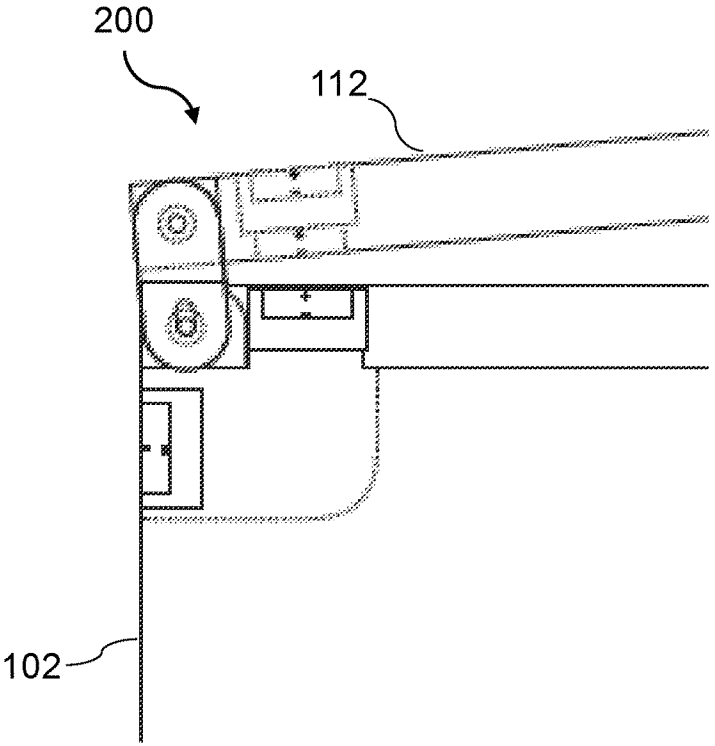
FIG. 8 is a side elevation view of the hinge assembly of FIG. 7 depicting the release of magnets holding the front flap in the open position.

FIGS. 8 to 12 show an example illustrating the movement and action of the hinge assembly 200 as it goes from the open position to the closed position. FIG. 8 is a side elevation view of the hinge assembly 200 depicting the release of the magnets holding the front flap 112 in the open position. Lifting the front flap 112 releases the hold between the first magnets 208 and the third magnet 212, which holds the front flap 112 in position in the open position, and allows the pin 204 to travel along the slot 206 in the hinge 202.

Figure 9:
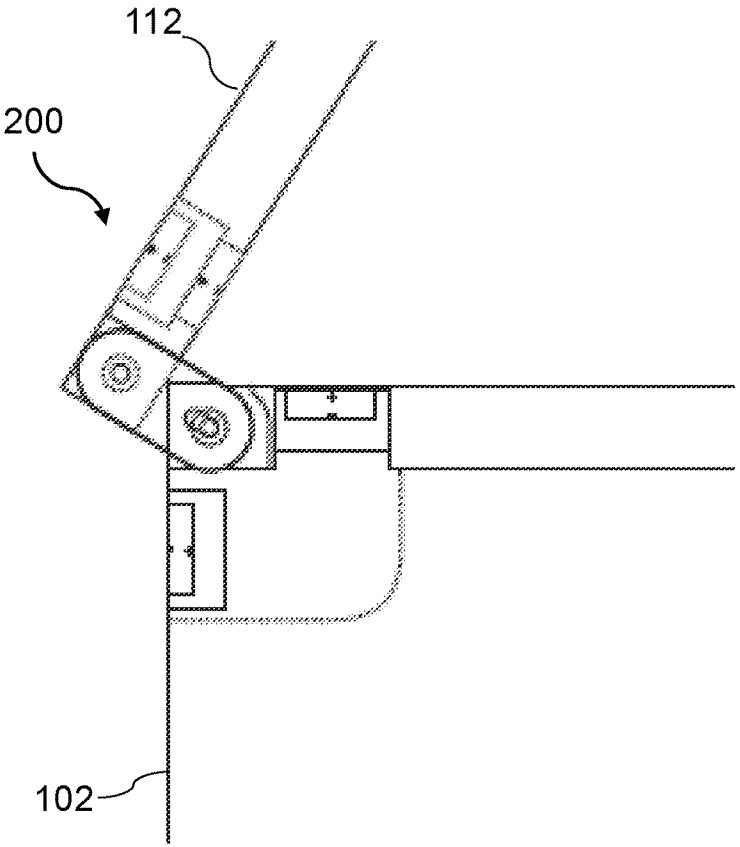
FIG. 9 is a side elevation view of the hinge assembly of FIG. 7 depicting the front flap rotating around a slotted pin, at approximately 60 degrees.
Figure 11:
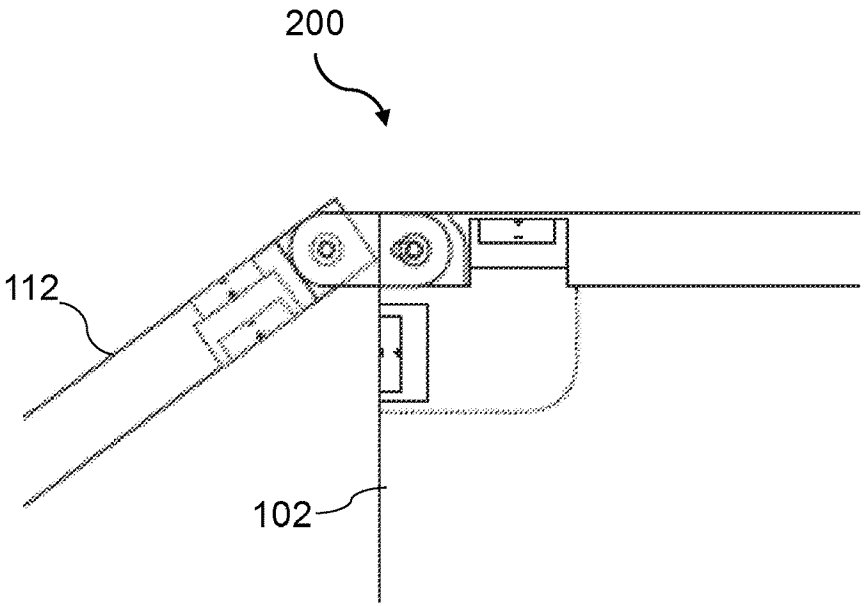
FIG. 11 is a side elevation view of the hinge assembly of FIG. 7 depicting the front flap rotating around the pin, at approximately 215 degrees.
Figure 10:
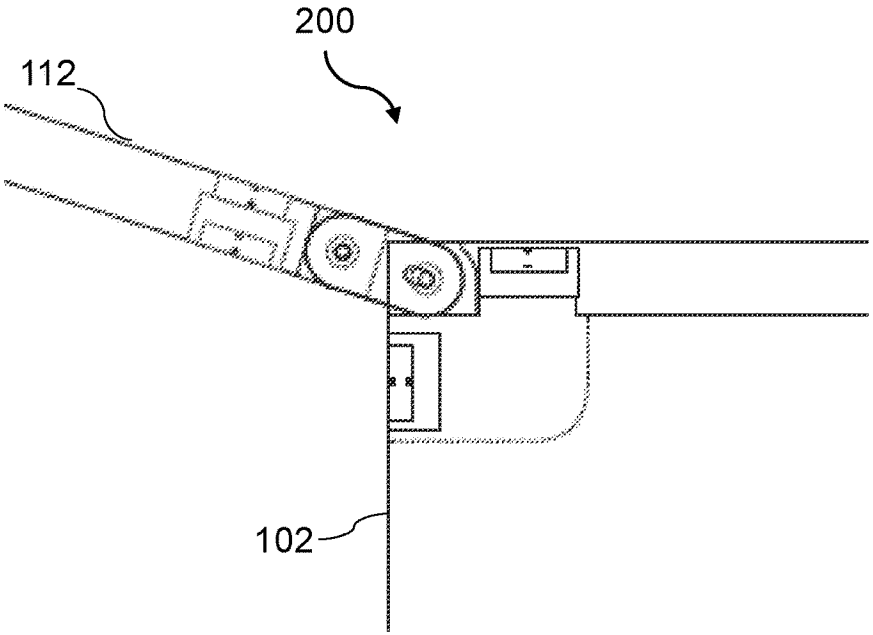
FIG. 10 is a side elevation view of the hinge assembly of FIG. 7 depicting the front flap rotating around the pin and slotted pin, at approximately 160 degrees.

FIG. 9 is a side elevation view of the hinge assembly 200 depicting the front flap 112 rotating around the pin 204 in the slot 206 (at approximately 60 degrees), with clearance around the edges. FIG. 10 is a side elevation view of the hinge assembly 200 depicting the front flap 112 rotating around the pin 204 in the slot 206 (at approximately 160 degrees), with clearance around the edges. FIG. 11 is a side elevation view of the hinge assembly 200 depicting the front flap 112 rotating around the pin (at approximately 215 degrees), with clearance around the edges. As illustrated, the slot 206 in the hinge 202 allows for clearance for the end of the front flap 112 and the corner of the back rest 102 as the front flap 112 rotates around the pin 204.

Figure 12:
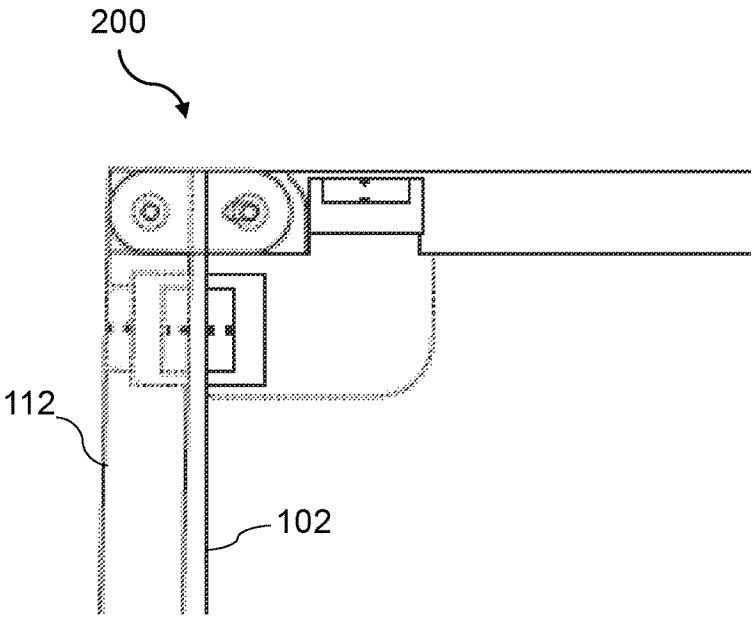
FIG. 12 is a side elevation view of the hinge assembly of FIG. 7 depicting the front flap having rotated the full 270 degrees.

FIG. 12 is a side elevation view of the hinge assembly 200 depicting the front flap 112 having rotated nearly the full 270 degrees. Once fully rotated around 270 degrees, the second magnet 210 and the fourth magnet 214 are aligned, and the slot 206 in the hinge 202 is lined up.

Figure 13:
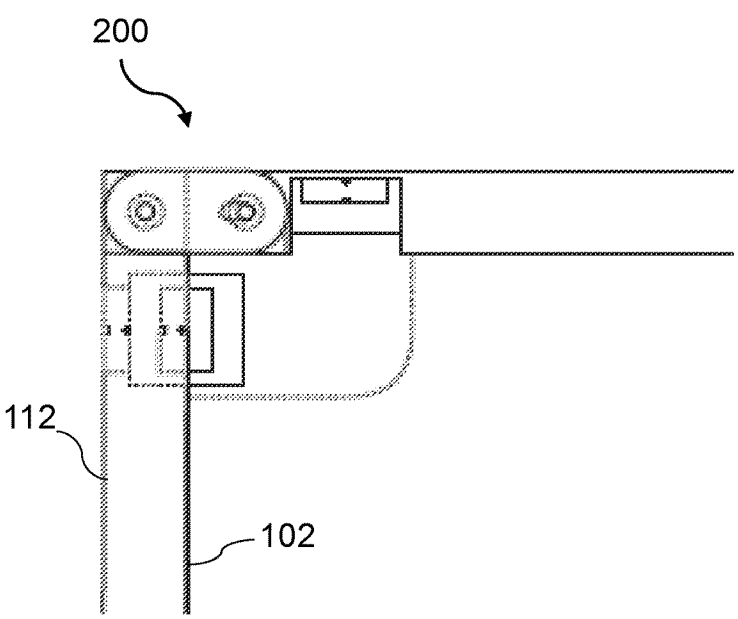
FIG. 13 is a side elevation view of the hinge assembly depicting the magnets pulling in the front flap to abut the back rest and seal a front exposure.

FIG. 13 is a side elevation view of the hinge assembly depicting the magnets pulling in the front flap 112 to abut the back rest 102, and thus, seal the front exposure of the cushions. The second magnet 210, cooperating with the fourth magnet 214, pulls the front flap 112 along the slot 206 in the hinge 202, to seal the front flap 112 against the top of the back rest 102 and the front of the seat rest 104.

While FIGS. 7 to 12 describe the operation of one of the hinge assemblies 200 between the front flap 112 and the back rest 102, it is understood that the hinge assemblies 200 between the rear flap 114 and the back rest 102 operate in the same manner as described.

Advantageously, using the magnetic hinge assemblies 200, a user can transition the seat 100 from the open position to the closed position, and vice versa, quickly and with minimal effort; while the hinge assembly 200 is relatively durable to repeated use. In this way, protection of the cushions and seating from weather, dirt, and the elements can generally be accomplished one-handed; as no latches or other mechanisms need to be operated.

While the presently illustrated embodiments show two hinge assemblies 200 between the front flap 112 and the back rest 102 and two hinge assemblies 200 between the rear flap 114 and the back rest 102, any suitable number of hinge assemblies 200 can be used. Additionally, additional magnets can be used to secure the flaps in one or more of the configurations; such as having additional magnets at the lateral edge of the flaps and corresponding magnets at the seat rest 104.

In further cases, rubber strips, or other types of weather sealing, can be located on portions of the seat 100 in order to provide additional sealing capabilities; for example, between where the seat rest 104 and the back rest 102 abut in the closed position, and between where the flaps 112 and 114 abut with the seat rest 104 and the back rest 102 in the closed position.

While the embodiments described herein describe the flaps 112 and 114 stored on the rear of the back rest 102 and rotated downwards, it is understood that in other embodiments the flaps could be stored underneath the seat rest 104 and rotated upwards to seal the front and rear of the seat 100 in the closed position. Additionally, while the embodiments described herein illustrate a front flap and a rear flap, in further cases, the rear of the seat rest 104 and the bottom of the back rest 102 can be permanently sealed; and in such cases, only the front flap 112 would be necessary for sealing the cushions in the closed position.

While the embodiments described herein illustrate a solid material for the flaps 112 and 114, it is understood that the flaps could comprise a soft material. For example, having rolls of vinyl roller shade located behind the back rest 102 and pulled to cover the front and rear of the seat in the closed position; where the shade could be held in place in the closed position by magnet(s) or hook(s). In further cases, the flaps 112 and 114 could be comprised of weather-proof canvas. Additionally, while the embodiments described herein illustrate that the flaps 112 and 114 are rotatably connected to the back rest 102, in further cases, the flaps 112 and 114 could be separate pieces that are brought by the user to cover the front and rear of the seat 100 in the closed position; potentially held in place by the magnets as described.

While the embodiments described herein describe the hinge assembly of FIGS. 7 to 12, it is understood that other suitable hinges can be used. For example, a hinge that includes a thin plastic portion as the point of rotation and that is capable of rotating the full 270 degrees.

While the embodiments described herein illustrate a chair, it is understood that the present inventive aspects could be applied to any suitable type of seating furniture; such as an outdoor sofa, loveseat, lounge, or dining chair.

Although the foregoing has been described with reference to certain specific embodiments, various modifications thereto will be apparent to those skilled in the art without departing from the spirit and scope of the invention as outlined in the appended claims.

The invention claimed is:

1. An outdoor seat collapsible from an open position to a closed position, the seat comprising:

a seat rest comprising a first end at a front and a second end at a rear of the seat rest;

a back rest comprising a first end at a top and a second end at a bottom of the back rest, the back rest rotatably connected to the seat rest at respective second ends of the back rest and the seat rest, wherein to move to the closed position, the back rest rotates until the back rest abuts a top of the seat rest;

a plurality of legs connected to the seat rest, the back rest, or both;

a first flap rotatably connected to the first end of one of the back rest or the seat rest, the first flap rotates to cover front facing portions of the back rest and the seat rest while in the closed position; and a second flap rotatably connected to the second end of one of the back rest or the seat rest, and wherein while in the closed position, the second flap rotates to cover rear facing portions of the back rest and the seat rest.

2. The outdoor seat of claim 1, wherein the back rest receives a back cushion therein and the seat rest receives a seat cushion therein, wherein the second flap seals a rear facing exposure of the back cushion and the seat cushion while in the closed position, and wherein the first flap seals a front facing exposure of the back cushion and the seat cushion while in the closed position.

3. The outdoor seat of claim 1, wherein the first flap is located behind the back rest and substantially parallel with a plane of the back rest while in the open position, the rotatable connection located between a top edge of the first flap and a top-rear edge of the back rest when viewed in the closed position.

4. The outdoor seat of claim 1, wherein the rotatable connection between the first flap and the back rest comprises a hinge assembly that rotates the first flap approximately 270 degrees.

5. The outdoor seat of claim 4, wherein the hinge assembly comprises an elongated hinge, a first pin connected to the first flap, and a second pin connected to the back rest, the hinge defining a hole proximate to a first end and a slot proximate to a second end, the hole receives the first pin to permit rotation of the first flap relative to the hinge, the slot receives the second pin to permit rotation and lateral movement of the hinge relative to the back rest.

6. The outdoor seat of claim 5, further comprising two or more of the hinge assemblies between the first flap and the back rest.

7. The outdoor seat of claim 5, wherein the hinge assembly further comprises a first magnet located on a side of the first flap that is proximate to the back rest in the open position, a second magnet located on a side of the first flap that is proximate to the back rest in the closed position, a third magnet located on the back rest and positioned to magnetically couple with the first magnet in the open position, and a fourth magnet located on the back rest and positioned to magnetically couple with the second magnet in the closed position.

8. The outdoor seat of claim 7, wherein at least one of the first magnet, the second magnet, the third magnet, and the fourth magnet are located in a ferromagnetic magnet cup.

9. The outdoor seat of claim 7, wherein at least one of the first magnet, the second magnet, the third magnet, and the fourth magnet comprise ferromagnetic material.

10. The outdoor seat of claim 1, further comprising arm rests rotatably connected to the legs, the arm rests rotate to abut a rear of the back rest while in the closed position.

* * * * *